US007560981B2

(12) United States Patent
Chao et al.

(10) Patent No.: US 7,560,981 B2
(45) Date of Patent: Jul. 14, 2009

(54) CONTROLLING APPARATUS FOR CONTROLLING A PLURALITY OF LED STRINGS AND RELATED LIGHT MODULES

(75) Inventors: Han-Yu Chao, Tainan Hsien (TW); Bi-Hsien Chen, Ping-Tung Hsien (TW); Shin-Chang Lin, Taipei Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 108 days.

(21) Appl. No.: 11/672,514

(22) Filed: Feb. 7, 2007

(65) Prior Publication Data

US 2008/0116817 A1 May 22, 2008

(30) Foreign Application Priority Data

Nov. 16, 2006 (TW) ..... 95142453 A

(51) Int. Cl.
*G05F 1/10* (2006.01)

(52) U.S. Cl. ..... 327/540; 327/541; 315/216; 315/294

(58) Field of Classification Search ..... None
See application file for complete search history.

(56) References Cited

U.S. PATENT DOCUMENTS 5,144,117 A * 9/1992 Hasegawa et al. ..... 235/455
5,701,133 A 12/1997 Miller et al.
6,400,101 B1 6/2002 Biebl et al.
6,556,067 B2 4/2003 Henry
6,577,512 B2 6/2003 Tripathi et al.
6,621,235 B2 * 9/2003 Chang ..... 315/216
6,636,003 B2 * 10/2003 Rahm et al. ..... 315/179
6,636,104 B2 10/2003 Henry
6,864,641 B2 * 3/2005 Dygert ..... 315/216
6,933,707 B2 8/2005 Allen
2003/0025120 A1 2/2003 Chang
2003/0169097 A1 9/2003 Henry
2004/0013139 A1 1/2004 Allen
2005/0152123 A1 7/2005 Voreis et al.

* cited by examiner

*Primary Examiner*—An T Luu
(74) *Attorney, Agent, or Firm*—Winston Hsu

(57) ABSTRACT

A controlling apparatus for controlling a plurality of LED strings and related light modules is disclosed, wherein each of the plurality of LED strings has a first terminal being electrically connected to an operating voltage. The controlling apparatus includes: a plurality of transistors, each having a control terminal, a first terminal, and a second terminal, wherein the first terminal of each transistor is electrically connected to a second terminal of a corresponding string of the plurality of LED strings, and the second terminals of the plurality of transistors are respectively grounded through a plurality of impedance elements; and a transistor controller, electrically connected to the control terminals of the plurality of transistors, for controlling a current of the first terminal of each transistor by adjusting an input signal of the control terminal of the transistor according to a voltage at the second terminal of the transistor.

27 Claims, 2 Drawing Sheets

CONTROLLING APPARATUS FOR CONTROLLING A PLURALITY OF LED STRINGS AND RELATED LIGHT MODULES

BACKGROUND OF THE INVENTION

1. Field of the Invention

The present invention relates to a scheme for controlling light-emitting diodes (LED), and more particularly, to a controlling apparatus and related lighting module for controlling a plurality of LED strings.

2. Description of the Prior Art

Recently, light sources implemented with light-emitting diodes (LED) have become more popular. For example, light sources in a backlight module in a conventional liquid crystal display (LCD) panel are usually implemented with cold cathode fluorescent lamps (CCFL). However, as the optical efficiency of an LED increases repeatedly, and cost of the LED decreases continuously, the cold cathode fluorescent lamps are replaced by light-emitting diodes gradually as light sources in a backlight module due to their being more economical.

In the prior art schemes, multiple light-emitting diodes are connected in sequence for reducing the number of required driving circuits, and for decreasing a total driving current utilized for driving the light-emitting diodes. However, because of fabrication process variations of different light-emitting diodes, it is very difficult to ensure that parameters of the light-emitting diodes in different LED strings are identical. Additionally, the parameters of the light-emitting diodes may usually be affected by some environmental factors (e.g. temperature). For instance, the forward voltages (VF) of different light-emitting diodes are usually a little different due to the above-mentioned factors. Therefore, the scheme utilizing multiple light-emitting diodes connected in sequence to be an LED string will accumulate forward voltage differences caused by different light-emitting diodes in the LED string. Usually, the total voltage differences accumulated by the forward voltage differences in different LED strings are also different.

In this situation, even though an identical operating voltage is applied for driving all LED strings, currents passing through different LED strings are also different since the accumulated values of the forward voltage differences in different LED strings are not identical. Therefore, the brightness of different LED strings will be different because currents passing through different LED strings are not identical. If the above-mentioned LED strings are used as light sources in a backlight module in an LCD panel, inconsistencies will be introduced on the display area of the LCD panel, since the brightness of the lighting source in the backlight module is uneven.

SUMMARY OF THE INVENTION

Therefore one of the objectives of the present invention is to provide a controlling apparatus and related lighting module for controlling the brightness of a plurality of LED strings, to solve the above-mentioned problems.

According to the claimed invention, a controlling apparatus for controlling a plurality of LED strings is disclosed. The first terminals of the plurality of LED strings are electronically connected to an operating voltage. The controlling apparatus comprises a plurality of transistors and a transistor controller. Each of the plurality of transistors has a control terminal, a first terminal being electronically connected to a second terminal of a corresponding LED string in the plurality of LED strings, and a second terminal. The second terminals of the plurality of transistors are respectively grounded through a plurality of impedance elements. The transistor controller is electronically connected to the second terminals of the plurality of transistors and is utilized for adjusting an input signal of the control terminal of each transistor to control a current passing through the first terminal of the transistor according to a voltage at the second terminal of the transistor.

According to the claimed invention, a lighting module is disclosed. The lighting module comprises a plurality of LED strings, a plurality of transistors, an error calculating circuit, and a transistor controller. Each of the LED strings has a first terminal being electronically connected to an operating voltage and a second terminal. Each of the transistors has a control terminal, a first terminal, and a second terminal. The first terminal of each transistor is electronically connected to a second terminal of a corresponding LED string in the plurality of the LED strings. The second terminals of the plurality of transistors are grounded through a plurality of impedance elements respectively. The error calculating circuit is electronically connected to the second terminals of the plurality of transistors and is utilized for calculating a difference between a voltage at the second terminal of each transistor and a corresponding reference voltage. The transistor controller is electronically connected to the error calculating circuit and the control terminals of the plurality of transistors, and is utilized for controlling a current passing through the first terminal of each transistor according to a calculation result generated by the error calculating circuit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
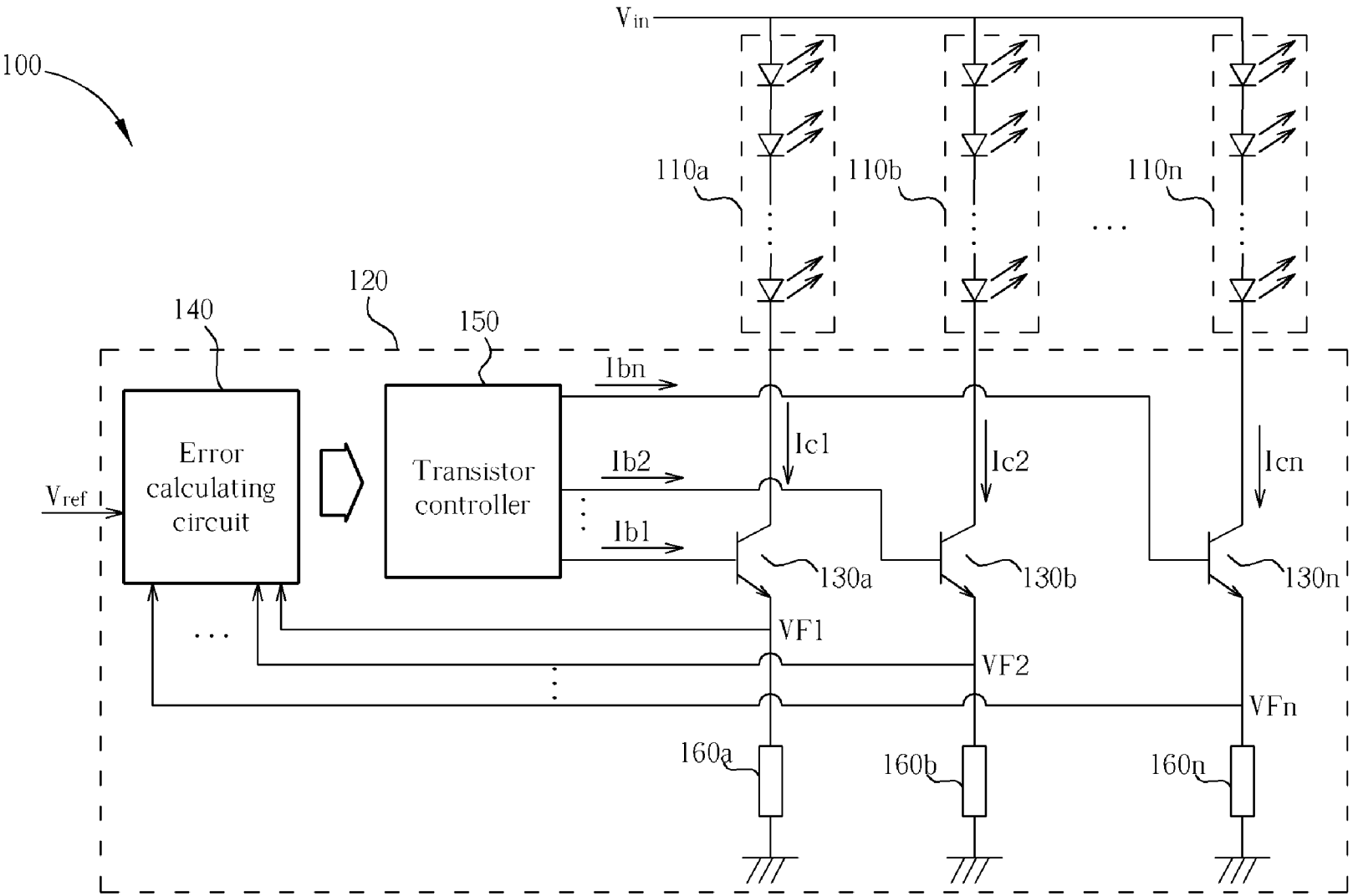
FIG. 1 is a simplified diagram of a lighting module according to an embodiment of the present invention.

Please refer to FIG. 1. FIG. 1 is a simplified diagram of a lighting module 100 according to an embodiment of the present invention. As shown in FIG. 1, the lighting module 100 comprises a plurality of LED strings 110*a*~110*n* and a controlling apparatus 120 utilized for controlling the LED strings 110*a*~110*n*. The first terminals of the LED strings 110*a*~110*n* are electronically connected to an operating voltage Vin, and each of the LED strings 111*a*~110*n* has the same number of light-emitting diodes corresponding to the same color. The controlling apparatus 120 in the lighting module 100 is utilized for controlling the LED strings 110*a*~110*n* to achieve that the brightness of the LED strings 110*a*~110*n* is identical substantially. The controlling apparatus 120 comprises a plurality of transistors 130*a*~130*n*, an error calculating circuit 140, a transistor controller 150, and a plurality of impedance elements 160*a*~160*n*. In this embodiment, the impedances of the impedance elements 160*a*~160*n* are substantially identical. For example, the impedance elements 160*a*~160*n* can be implemented with a plurality of resistance units having substantially identical resistances. The operation of the controlling apparatus 120 is detailed below as follows.

In this embodiment, the transistors 130*a*~130*n* in the controlling apparatus 120 are bipolar junction transistors (BJT), and each of the transistors 130*a*~130*n* has a control terminal (base), a first terminal (collector), and a second terminal (emitter). As shown in FIG. 1, the collectors of the transistors 130*a*~130*n* are electronically connected to the second terminals of the LED strings 110*a*~110*n*, and the emitters of the transistors 130*a*~130*n* are grounded through the impedance elements 160*a*~160*n* respectively. In practice, for increasing the performance of the controlling apparatus 120 and for reducing complexity, it is preferred that the common-emitter current gains of the transistors 130*a*~130*n* are substantially identical and the transistors 130*a*~130*n* are operated in the active region. However, this is not intended to be a limitation of the present invention.

As mentioned above, because of fabrication process variations of different light-emitting diodes, or environmental factors (e.g. temperature), the total voltage difference accumulated by the forward voltage differences in each of the LED strings 110*a*~110*n* may be different than that of others in the LED strings 110*a*~110*n*. The currents Ic1~Icn passing through the LED strings 110*a*~110*n* are therefore different. The controlling apparatus 120 is utilized for controlling the currents Ic1~Icn passing through the LED strings 110*a*~110*n* by respectively utilizing the transistors 130*a*~130*n* so that the brightness of the LED strings 110*a*~110*n* is substantially identical.

More specifically, in the controlling apparatus 120, the error calculating circuit 140 is utilized for calculating a difference between the voltage VF1 at an emitter of each of the transistors 130*a*~130*n* and a corresponding reference voltage Vref. In a preferred embodiment, the error calculating circuit 140 can amplify a difference between the voltage VF1 at an emitter of each in the transistors 130*a*~130*n* and the corresponding reference voltage Vref for boosting the difference. In practice, the error calculating circuit 140 can be implemented with an operational amplifier or multiple operational amplifiers. For instance, the error calculating circuit 140 can be implemented by only one operational amplifier for calculating differences between voltages at the emitters of the transistors 130*a*~130*n* and the corresponding reference voltage Vref respectively. Otherwise, the error calculating circuit 140 can also be implemented by a plurality of operational amplifiers calculating differences between voltages at the emitters of the transistors 130*a*~130*n* and the corresponding reference voltage Vref simultaneously. For example, a first operational amplifier (it is not shown in FIG. 1) is utilized for calculating a difference between a voltage VF1 at the emitter of the transistor 130*a* and the corresponding reference voltage Vref, and a second operational amplifier (it is not shown in FIG. 1) is utilized for calculating a difference between a voltage VF2 at the emitter of the transistor 130*b* and the corresponding reference voltage Vref simultaneously. It is preferred that the gain of the first operational amplifier is substantially identical to that of the second operational amplifier. The transistor controller 150 is utilized for adjusting a base current Ib1 passing through each of the transistors 130*a*~130*n* according to a calculation result generated by the error calculating circuit 140, for ensuring that the collector currents passing through the transistors 130*a*~130*n* (i.e. the currents Ic1~Icn passing through the LED strings 110*a*~110*n*) can be substantially identical. The detailed operation of the transistor controller 150 is illustrated in the following description.

Figure 2:
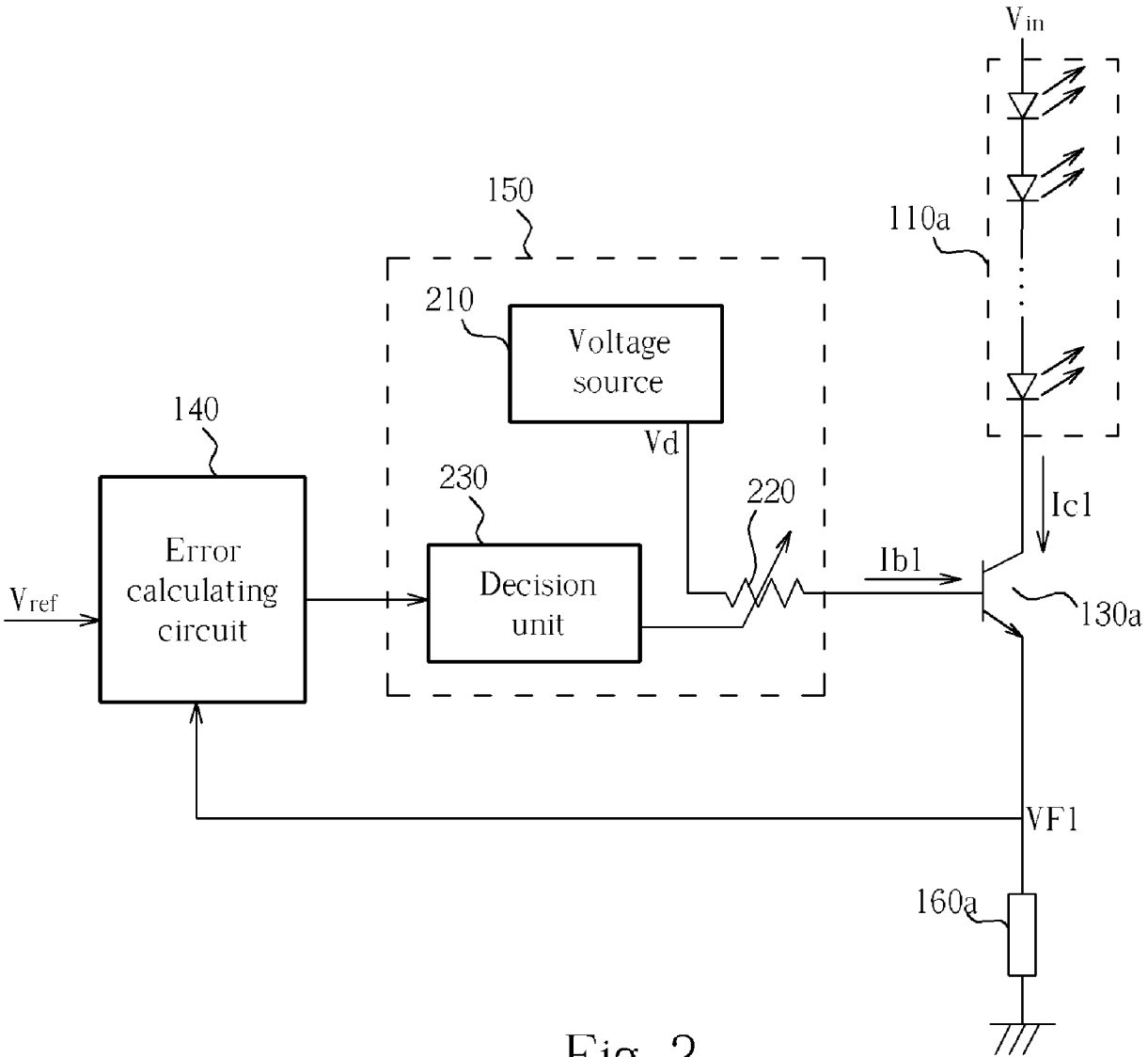
FIG. 2 is a simplified diagram of a transistor controller shown in FIG. 1.

Please refer to FIG. 2. FIG. 2 is a simplified diagram illustrating the operation of the transistor controller 150 shown in FIG. 1. Since the transistor controller 150 shown in FIG. 2 adjusts the collector current and the base current passing through each of the transistors 130*a*~130*n* by utilizing the scheme identical to that used by the transistor controller 150 shown in FIG. 1, only the following example is illustrated in FIG. 2.T*he* base current Ib1 passing through the transistor 130*a* is adjusted by the transistor controller 150. Since the operation and function of the other transistors, LED strings, and impedance elements is identical to that of the transistor 130*a*, the LED string 110*a*, and the impedance element 160*a*, further description is not detailed for brevity. As shown in FIG. 2, the transistor controller 150 comprises a voltage source 210, a variable resistor 220, and a decision unit 230. The voltage source 210 is utilized for outputting a predetermined voltage Vd, and the variable resistor 220 is electronically connected between the voltage source 210 and the base of the transistor 130*a*. The decision unit 230 is electronically connected to the error calculating circuit 140 and the variable resistor 220, and is utilized for controlling a resistance of the variable resistor 220 to adjust the base current Ib1 passing through the transistor 130*a* according to the calculation result generated by the error calculating circuit 140.

When the transistor 130*a* is operating in the active region, the following equation relates to the collector current Ic1 and base current Ib1 established:

$$Ic1=\beta\times Ib1 \qquad \text{Equation (1)}$$

wherein the parameter β is meant to be the common-emitter current gain of the transistor 130*a*. In addition, a calculation result Ver1, calculated by the error calculating circuit 140, corresponding to the difference between the voltage VF1 at the emitter of the transistor 130*a* and the corresponding reference voltage Vref can be represented as follows:

$$Ver1=A\times(Vref-VF1) \qquad \text{Equation (2)}$$

wherein the parameter A is meant to be the gain of the error calculating circuit 140. It is assumed that the resistance of the variable resistor 220 equals to a resistance R1. The relation between the resistance R1 and the base current Ib1 passing through the transistor 130*a* can be represented as Equation (3):

$$Ib1\times R1=Ver1-(VF1+Vbe) \qquad \text{Equation (3)}$$

wherein the parameter Vbe is meant to a voltage drop between the base and emitter of the transistor 130*a*. By Equation (3), the base current Ib1 passing through the transistor 130*a* can be represented as Equation (4):

$$Ib1=\frac{Ver1-(VF1+Vbe)}{R1}. \qquad \text{Equation (4)}$$

Similarly, the base current Ib1 passing through the transistor 130*a* can be represented as Equation (5) by Equation (2):

$$Ib1=\frac{A\times(Vref-VF1)-(VF1+Vbe)}{R1}=\frac{A\times Vref-(A+1)\times VF1-Vbe}{R1}. \qquad \text{Equation (5)}$$

By a relation between Equation (1) and Equation (5), the collector current Ic1 can be illustrated by the following equation:

$$Ic1 = \beta \times \frac{A \times Vref - (A+1) \times VF1 - Vbe}{R1}. \quad \text{Equation (6)}$$

Suppose that equations K1=β×A and K2=β×(A+1) are established. Since the gain the A of the error calculating circuit 140 is usually larger than unity, the parameters K1 and K2 are approximate. Equation (6) can be rewritten as follows:

$$Ic1 = \frac{K1 \times (Vref - VF1) - Vbe \times \beta}{R1} = \frac{K1 \times Ver1 - Vbe \times \beta}{R1}. \quad \text{Equation (7)}$$

Since the parameters K1, Vbe, and β in Equation (7) are fixed, the decision unit 230 in the transistor controller 150 can control the resistance R1 of the variable resistor 220 for adjusting the base current Ib1 passing through the transistor 130*a* according to the calculation result Ver1 generated by the error calculating circuit 140. Therefore, the decision unit 230 can control the collector current Ic1 passing through the transistor 130*a* by adjusting the base current Ib1 passing through the transistor 130*a*. In this embodiment, the decision unit 230 keeps the collector current Ic1 passing through the transistor 130*a* at a predetermined value or within a predetermined range by adjusting the resistance R1 of the variable resistor 220. The above-mentioned scheme for controlling the collector current Ic1 passing through the transistor 130*a* can also be applied in controlling the collector currents Ic2~Icn passing through the other transistors 130*b*~130*n*. Therefore, the currents Ic1~Icn passing through the LED strings 110*a*~110*n* will be substantially identical, and the brightness of the LED strings 110*a*~110*n*, which are not identical in the prior art, are avoided. If a lighting source in a backlight module corresponding to the LCD panel is implemented with the lighting module 100, the lighting inconsistency will be not introduced on a display area of an LCD panel.

In the above-mentioned embodiment, the light-emitting diodes included within the LED strings 110*a*~110*n* in the lighting module 100 all correspond to the same color. However, this is not meant to be a limitation of the present invention. The light-emitting diodes included within different LED strings can also correspond to different colors. For example, the light-emitting diodes in at least an LED string corresponding to a first color and the light-emitting diodes in at least an LED string corresponding to a second color can be included in the LED strings 110*a*~110*n*. In practice, the total voltage values accumulated by the forward voltages in the LED strings corresponding to different colors may not be identical. One of solutions is to utilize different corresponding reference voltages corresponding to different colors. Therefore, the error calculating circuit 140 can generate a calculation result to the transistor controller 150 according to a specific corresponding reference voltage of a specific color and a voltage at an emitter of a transistor in the LED string corresponding to the specific color. Additionally, the decision unit 230 in the transistor controller 150 can set different target currents in accordance with different colors respectively and adjust the brightness of each of the LED strings by the above-mentioned scheme for controlling the collector currents Ic1~Icn.

In addition, in other embodiments, part or all of the transistors 130*a*~130*n* (i.e. bipolar junction transistors) in the controlling apparatus 120 can be replaced with insulated-gate bipolar transistors (IGBT). It is preferred that the insulated-gate bipolar transistors have the substantially the same transconductance. It should also be noted that the control terminal of an insulated-gate bipolar transistor is a gate of the insulated-gate bipolar transistor, and the first and second terminals of the insulated-gate bipolar transistor are a collector and emitter of the insulated-gate bipolar transistor respectively. The error calculating circuit 140 calculates a calculation result according to a voltage at the emitter of each insulated-gate bipolar transistor. The transistor controller 150 adjusts an input voltage at the gate of the insulated-gate bipolar transistor to control a collector current passing through the insulated-gate bipolar transistor according to the calculation result generated by the error calculating circuit 140. This also obeys the spirit of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A controlling apparatus for controlling a plurality of LED strings, wherein each of the plurality of LED strings has a first terminal being electrically connected to an operating voltage, the controlling apparatus comprising:

a plurality of transistors, each having a control terminal, a first terminal, and a second terminal, the first terminal of each transistor being electrically connected to a second terminal of a corresponding string of the plurality of LED strings, and the second terminals of the plurality of transistors being respectively grounded through a plurality of impedance elements;

a transistor controller, electrically connected to the control terminals of the plurality of transistors, for controlling a current passing through the first terminal of each transistor by adjusting an input signal of the control terminal of the transistor according to a voltage at the second terminal of the transistor; and an error calculating circuit, electrically connected to the transistor controller and the second terminals of the plurality of transistors, for calculating a difference between the voltage at the second terminal of each transistor and a corresponding reference voltage; wherein the transistor controller adjusts the input signal of the control terminal of the transistor according to a calculation result generated by the error calculating circuit.

2. The controlling apparatus of claim 1, wherein the control terminal of the transistor is a base of the transistor; the first terminal of the transistor is a collector of the transistor; and the second terminal of the transistor is an emitter of the transistor.

3. The controlling apparatus of claim 1, wherein the error calculating circuit amplifies the difference between the voltage at the second terminal of the transistor and the corresponding reference voltage.

4. The controlling apparatus of claim 1, wherein the error calculating circuit comprises:

a first operational amplifier, for respectively calculating differences between voltages of the second terminals of the plurality of transistors and the corresponding reference voltage.

5. The controlling apparatus of claim 4, wherein the error calculating circuit further comprises:

a second operational amplifier, for calculating a difference between a voltage at a second terminal of a second transistor and the corresponding reference voltage.

6. The controlling apparatus of claim 5, wherein the first and second operational amplifiers have identical gains substantially.

7. The controlling apparatus of claim 1, wherein the plurality of transistors are bipolar transistors.

8. The controlling apparatus of claim 7, wherein common-emitter current gains of the plurality of transistors are substantially identical.

9. The controlling apparatus of claim 7, wherein the transistor controller comprises:

a voltage source, for outputting a predetermined voltage;

a variable resistor, electronically connected between the voltage source and a control terminal of a corresponding transistor in the plurality of transistors; and a decision unit, electronically connected to the error calculating circuit and the variable resistor, for adjusting a resistance of the variable resistor to control an input current passing through the control terminal of the corresponding transistor according to the calculation result generated by the error calculating circuit.

10. The controlling apparatus of claim 1, wherein the plurality of transistors are insulated gate bipolar transistors (IGBT).

11. The controlling apparatus of claim 10, wherein transconductances of the plurality of transistors are substantially identical.

12. The controlling apparatus of claim 10, wherein the transistor controller adjusts an input voltage at the control terminal of the transistor to control the current passing through the first terminal of the transistor according to the calculation result generated by the error calculating circuit.

13. The controlling apparatus of claim 1, wherein the plurality of transistors comprise at least a bipolar junction transistor and at least an insulated gate bipolar transistor.

14. The controlling apparatus of claim 1, wherein impedances of the plurality of impedance elements are substantially identical.

15. The controlling apparatus of claim 1, wherein the plurality of LED strings comprise a first LED string corresponding to a first color and a second LED string corresponding to a second color.

16. The controlling apparatus of claim 1, wherein the plurality of transistors operate in an active region.

17. A lighting module, comprising:

a plurality of LED strings, each having a first terminal and a second terminal, the first terminal of each LED string being electronically connected to an operating voltage;

a plurality of transistors, each having a control terminal, a first terminal, and a second terminal, the first terminal of each transistor being electronically connected to a second terminal of a corresponding LED string in the plurality of LED strings, and the second terminals of the plurality of transistors being respectively grounded through a plurality of impedance elements;

an error calculating circuit, electronically connected to the second terminals of the plurality of transistors, for calculating a difference between a voltage at the second terminal of the transistor and a corresponding reference voltage respectively; and a transistor controller, electronically connected to the error calculating circuit and the control terminals of the plurality of transistors, for controlling a current passing through the first terminal of the transistor according to a calculation result generated by the error calculating circuit.

18. The lighting module of claim 17, wherein the plurality of transistors are bipolar transistors.

19. The lighting module of claim 18, wherein the transistor controller adjusts an input current passing through the control terminal of the transistor to control the current passing through the first terminal of the transistor according to the calculation result generated by the error calculating circuit.

20. The lighting module of claim 18, wherein common-emitter current gains of the plurality of transistors are substantially identical.

21. The lighting module of claim 17, wherein the plurality of transistors are insulated gate bipolar transistors.

22. The lighting module of claim 21, wherein the transistor controller adjusts an input voltage at the control terminal of the transistor to control the current passing through the first terminal of the transistor according to the calculation result generated by the error calculating circuit.

23. The lighting module of claim 17, wherein the plurality of LED strings correspond to an identical color.

24. The lighting module of claim 17, wherein the plurality of transistors operate in an active region.

25. The lighting module of claim 17, wherein the control terminal of the transistor is a base of the transistor; the first terminal of the transistor is a collector of the transistor; and the second terminal of the transistor is an emitter of the transistor.

26. A controlling apparatus for controlling a plurality of LED strings, wherein each of the plurality of LED strings has a first terminal being electrically connected to an operating voltage, the controlling apparatus comprising:

a plurality of transistors, each having a control terminal, a first terminal, and a second terminal, the first terminal of each transistor being electrically connected to a second terminal of a corresponding string of the plurality of LED strings, and the second terminals of the plurality of transistors being respectively grounded through a plurality of impedance elements, wherein the plurality of transistors are bipolar transistors;

an error calculating circuit, for generating a calculation result; and a transistor controller, electrically connected to the control terminals of the plurality of transistors, for controlling a current passing through the first terminal of each transistor by adjusting an input signal of the control terminal of the transistor according to a voltage at the second terminal of the transistor, wherein the transistor controller comprises:

a voltage source, for outputting a predetermined voltage;

a variable resistor, electronically connected between the voltage source and a control terminal of a corresponding transistor in the plurality of transistors; and a decision unit, electronically connected to the error calculating circuit and the variable resistor, for adjusting a resistance of the variable resistor to control an input current passing through the control terminal of the corresponding transistor according to the calculation result generated by the error calculating circuit.

27. A controlling apparatus for controlling a plurality of LED strings, wherein each of the plurality of LED strings has a first terminal being electrically connected to an operating voltage, the controlling apparatus comprising:

a plurality of transistors, each having a control terminal, a first terminal, and a second terminal, the first terminal of each transistor being electrically connected to a second terminal of a corresponding string of the plurality of LED strings, and the second terminals of the plurality of transistors being respectively grounded through a plurality of impedance elements, wherein the plurality of transistors are insulated gate bipolar transistors (IGBT);

an error calculating circuit, for generating a calculation result; and a transistor controller, electrically connected to the control terminals of the plurality of transistors, for controlling a current passing through the first terminal of each transistor by adjusting an input signal of the control terminal of the transistor according to a voltage at the second terminal of the transistor, wherein the transistor controller adjusts an input voltage at the control terminal of the transistor to control the current passing through the first terminal of the transistor according to the calculation result generated by the error calculating circuit.

* * * * *